United States Patent [19]

Long

[11] 4,335,877

[45] Jun. 22, 1982

[54] ROUND TABLE TENNIS TABLE

[76] Inventor: Donald L. Long, 5772 E. 12th St., Tucson, Ariz. 85711

[21] Appl. No.: 163,931

[22] Filed: Jun. 27, 1980

[51] Int. Cl.[3] ..... A63B 61/00

[52] U.S. Cl. ..... 273/30

[58] Field of Search ..... 273/30, 1 R, 29 R

[56] References Cited

U.S. PATENT DOCUMENTS

| | | | |
|---|---|---|---|
| 3,452,985 | 7/1969 | D'Zmura | 273/30 |
| 3,468,536 | 11/1969 | Minshull et al. | 273/30 |
| 3,526,404 | 11/1978 | Wiggins | 273/30 |
| 4,108,434 | 8/1978 | Royer | 273/30 |

*Primary Examiner*—Richard C. Pinkham
*Assistant Examiner*—T. Brown

[57] ABSTRACT

Round Table is a game table on which games can be played utilizing standard table tennis balls and paddles. The playing surface is flat and of circular shape. The playing surface can be divided into 2, 3, or 4 equal sections by dividers which radiate from the center of the playing surface. The dividers can be attached to one another by clips which fit over the top edge of the dividers. When the table is divided into 2 equal sections supports which attach to the bottom edge of the dividers can be used to hold the dividers upright. An optional post can be placed at the center of the playing surface and used for screening and deflecting shots. The hollow post would have 4 slots on one end and 3 on the other enabling the post to be slipped over the dividers at the center of the playing surface.

1 Claim, 4 Drawing Figures

ROUND TABLE TENNIS TABLE

SUMMARY

Round Table is a game table on which games can be played using standard table tennis balls and paddles. The Round Table can have legs of it's own or a legless version can sit on other tables. The table can be divided into 2, 3 or 4 equal sections by dividers which clip together at the middle of the table. A post can be placed at the center of the table to screen an opponent with or deflect the ball off of.

A game I call Rotation can be played by 2 players on the table when divided into 3 or 4 sections. The basic idea is to hit the ball into a section other than the one it just bounced in.

In 3 to 1 and 2 to 1, 2 players play on a table divided into 3 or 4 sections. One player defends 1 section, the other player the other sections. After every five points they switch situations.

In 1 to 1 the table is in 2 sections. Two players play, each defending a section. Almost the same game can be played on a table divided into 4 sections. Each player would defend 2 sections.

Three players compete in 3 Way where the table is divided into 3 sections, each player defending a section. When a player fails to make a proper return the player who hit the ball to him or her scores the point.

4 Way is virtually the same except 4 players play on a table divided into 4 sections.

DESCRIPTION OF THE DRAWINGS

Illustration no. 1 shows the Round Table (no.11) divided into 3 sections with the optional screen deflection post (no.10) in the center. Illustration no. 2 shows how the various parts in the proceding illustration fit together. Illustration no. 3 shows the table (no.11) divided into 2 sections with the optional post (no.10). Illustration no.4 shows the table (no.14) divided into 4 sections with the post (no.10). Also in no. 4 the table (no.14) is legless and sits on a rebound pool table (no.13). The various parts in illustrations 3 and 4 fit together in a manner similar to illustration no.2.

DETAIL DESCRIPTION

Figure 1:
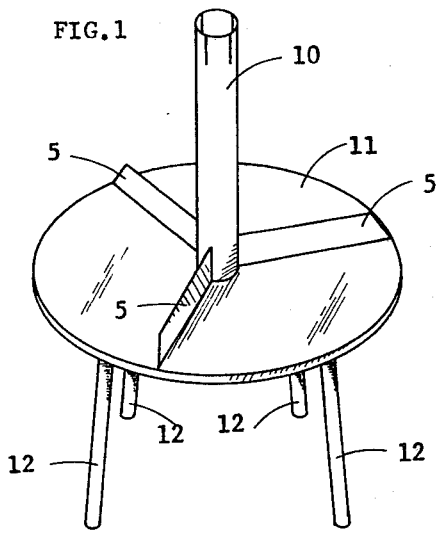
Figure 2:
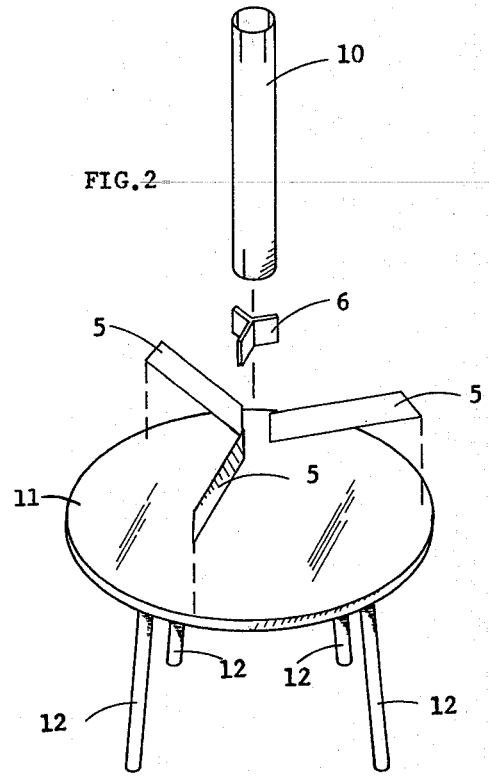
Figure 3:
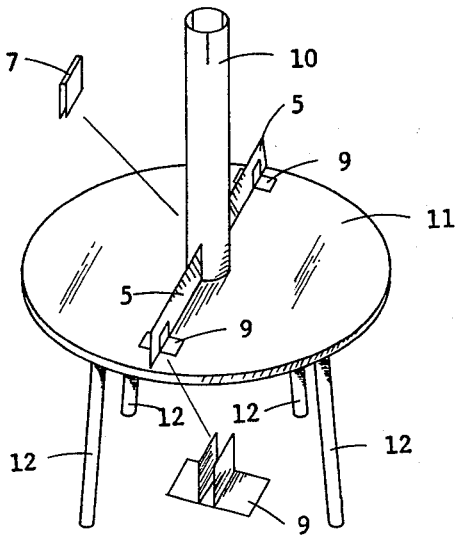
Figure 4:
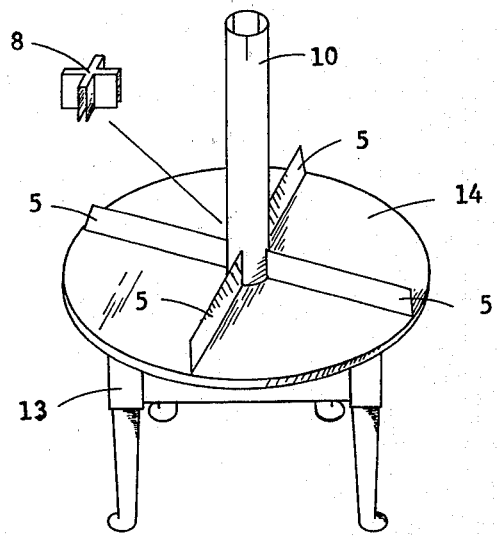

The Round Table (no.11) is a game table on which games are played with standard table tennis balls and paddles. It is made of a partical board, composition board type materials and can range in size from around 4 to 8 feet in diameter. The table can have stationary legs (no.12), folding legs or a legless version (no.14) can sit on other tables like the rebound pool table (no.13) in illustration no.4.

Round Table can be, as shown in the illustrations, divided into 2, 3 or 4 equal sections by a series of dividers (no.5), and clips (no.6, 7 and 8) which hold the dividers together at the center of the table at the proper angle in relation to each other. In this manner there is nothing to tie and untie or screw and unscrew. The dividers could be opaque, semi-transparent or clear and could be made out of various materials although some kind of plastic would be the most economical. When the table is divided into 2 parts, supports (no.9) are needed to hold the dividers upright unless the screen deflection post is placed in the center. The supports would be made out of the same material as the clips. The dividers would be around 5 inches tall on a four foot table. The outside edge of the dividers slant inward to avoid being hit by players moving around the table. The wider the table the higher the dividers would have to be.

The screen deflection post (no.10), which is optional, can be used to screen your shot or deflect the ball off of. If you deflect the ball off the post so the ball bounces back into the same section it previously bounced in, the other player wins the point. The post is a hard hollow tube which would probably be made from the same material as the dividers. It is about 2½ to 3 feet long, 3 to 4 inches wide on a 4 foot table. The wider the table, the wider the post should be. It will have 3 equally spaced slots at one end corresponding to the height and thickness of the dividers and 4 slots on the other end. If the players want to use the post they would merely need to slip the post over the dividers at the center of the table.

One rule which applies to all of the ways of playing is that you cannot touch the table, dividers or post with your paddle, any part of the body or clothing while the ball is in play. If you bounce the ball off the dividers so that it lands in the same section that it previously bounced in, your opponent wins the point. If you deflect the ball off the divider and it never hits an eligible section you also lose the point. On the serve, the ball must be projected into the air from an open, upward facing palm and struck before the ball enters the imaginery cylinder extending upward from the edge of the table. To serve in all of the games except: 4 section 1 to 1, you stand directly behind 1 of the sections and hit the ball so that it bounces once in that section then bounces into an eligible section. A player must wait until after the ball has bounced once in an eligible section to make a return. The point is dead as soon as the ball hits the floor, walls, ceiling, a player or any other object in the room. The player making the last good shot wins the point.

One way of playing, I call Rotation, because both players can move around the table several times clockwise and/or counter clockwise before the point is scored. It is played by two players with the table divided into 3 or 4 sections. After serving, the object is to hit the ball into a section other than the one it lands in. As soon as you hit the ball into a section you must move into a position where you can cover the open sections where the opponent can hit the ball into. Under these rules the players would stay reasonably clear of each other. If a player hinders his or her opponent by placing his or her body or paddle in a position so as to impede the opponent physically from making a return, that player would obviously lose the point. Another way of playing is called 3 to 1 or 2 to 1. This game is for two players with the table divided into 3 or 4 sections. The basic idea is that the server defends 1 section while the other player defends the remaining sections. After every 5 points they would switch situations.

Still another way of playing is called 1 to 1. In 1 to 1, two players play on a table divided into two sections. Each player would defend 1 section. This game could be played with the table divided into 4 sections. This would provide the players with something to screen his or her opponent with or deflect the ball off of. To serve you must stand in line with the divider seperating the 2 sections on your side of the table and serve the ball so that it bounces once in one of these sections and goes over the dividers and hits your opponent's side.

In 3 Way, 3 players play on a table divided into 3 sections. Each player defends a section and when a player can't make a successful return, the player who hit the ball to him or her wins the point.

4 Way is played exactly the same as 3 Way except the table is divided into 4 sections, and 4 players take part.

People playing just for fun obviously could keep score any way they want but for more serious playing such as in tournaments a standard scoring system would be needed. The scoring system for the games just described would be similar to table tennis. The first player to score 21 points and win by 2 points over his or her opponent or opponents wins that game. For a tournament match the winner would have to win 3 out of 5 games. The serve would change after every 5 points except in 3 Way and 4 Way where the serve would rotate around the table after every point. Both server and receiver or receivers can score points.

I claim:

1. A game table designed for playing variations of table tennis with standard table tennis balls and paddles, comprising:

(a) a table member having a planar playing surface of circular shape on its upper surface;

(b) a plurality of panels radiating from the center of the upper surface of the table member to the edge of the upper surface of the table member, said panels radially dividing the upper surface of the table into equal sized sections, said dividing panels having an upper edge which is parallel to the lower edge, the inner shorter edge of the dividing panels extending upward at a 90° angle from the center of the playing surface and the outer short edge sloping inwardly from the edge of the playing surface, said dividing panels being fastened to one another by means of clip members which attach to the upper portions of said panels where said panels converge at the center of playing surface, two support members which attach to the lower portions of the panels being used to secure the panels in an upright position when said panels are utilized to divide the playing surface into two equal sections;

(c) a cylindrical member of hollow disposition optionally usable for screening the ball and deflecting the ball, said cylindrical member having open ends and being located at the center of the playing surface, said cylindrical member having 3 equally spaced slots on one end and 4 on the other, the height and width of the slots being approximately the same as the height and width of the panel dividers enabling said cylindrical member to be placed over the panel dividers at the center of the playing surface.

* * * * *